US006237182B1

(12) United States Patent
Cassar

(10) Patent No.: US 6,237,182 B1
(45) Date of Patent: May 29, 2001

(54) FLEXIBLE ELASTOMER FLOOR DUST MOP ATTACHMENT

(76) Inventor: Simon Ralph Cassar, 36804 Solvay St., Palmdale, CA (US) 93552

( * ) Notice: Subject to any disclaimer, the term of this patent is extended or adjusted under 35 U.S.C. 154(b) by 0 days.

(21) Appl. No.: 09/548,339

(22) Filed: Apr. 12, 2000

(51) Int. Cl.[7] ..... A47L 13/20; A47L 13/252

(52) U.S. Cl. ..... 15/144.1; 15/228; 15/229.1; 15/229.6; 15/229.7

(58) Field of Search ..... 15/144.1, 172, 15/228, 229.1, 229.2, 229.6, 229.3, 229.4, 229.5, 229.7, 229.8, 229.9

(56) References Cited

U.S. PATENT DOCUMENTS 1,524,295 * 1/1925 Erickson ..... 15/229.9
2,056,934 * 10/1936 Bohnenblust ..... 15/229.8
2,646,588 * 7/1953 Wagner ..... 15/229.7
2,828,503 * 4/1958 Goldstein ..... 15/144.1
5,657,507 * 8/1997 Wasak ..... 15/144.1
5,673,452 * 10/1997 Chang ..... 15/144.1
6,094,768 * 8/2000 Hugon ..... 15/144.1

* cited by examiner

*Primary Examiner*—Randall E. Chin
(74) *Attorney, Agent, or Firm*—Thomas I. Rozsa; Tony D. Chen; Jerry Fong

(57) ABSTRACT

A unitary molded flexible elastomer floor dust mop attachment in which the flexible member is affixed at a location between the floor dust mop handle and the floor dust mop head. Through the use of the elastomeric controlled flexible member being rectangular or elongated in shape, the handle maintains rigidity in the direction in which the dust mop head is moved but is flexible in the lateral direction and therefore can be bent at controlled angles relative to the floor dust mop head. Therefore, when the floor dust mop head comes in contact with a stationary object such as the leg of a table, the floor dust mop head will flex or flow around the object without damage to the mop head or object.

16 Claims, 4 Drawing Sheets

FLEXIBLE ELASTOMER FLOOR DUST MOP ATTACHMENT

BACKGROUND OF THE INVENTION

1. Field of the Invention

The present invention relates to a dust mopping, cleaning or a sweeping apparatus and in particular to mops or applications where debris is being removed by an apparatus. The present invention relates to a unitary flexible molded elastomer attachment that requires no assembly and allows for the floor dust mop to automatically rebound back after hitting obstacles. The new innovation allows for flexible floor dust mops to be less expensive to manufacture and to reduce an operator workload.

2. Description of the Prior Art

The standard floor dust mop has two primary components. The first component is the floor dust mop head that comprises a rectangular structure usually made of a metal tube that supports therein a cloth covered sewn bag with a multiplicity of dust-absorbing cotton yarn-like strands. The support structure has a lateral cross bar which is used to attach the mop handle that is comprised of an assembled clamp mechanism consisting of springs and pivot rivets. The second primary component of the floor dust mop is the handle which is usually a cylindrical pole that is attached to a costly floor dust mop handle connector mechanism that requires assembly in order for the attachment to pivot in the transverse axis and allow the floor dust mop to move in multiple directions. The floor dust mop handle connector is removable and is typically fitted with a clamp that engages onto the floor dust mop frame. The floor dust mop handle connector is affixed to the top of the metal frame structure that supports the cotton skirt cover. The combination of the two permits the floor dust mop to be pushed and pulled by the exertion of a force on the handle and flex when coming in contact with obstacles.

One significant problem with flexible floor dust mops is the costly pivoting mechanism that allows the floor dust mop to flex around obstacles. Secondly, when the floor dust mop moves around an obstacle, the operator must twist the floor dust mop to regain the original position of the floor dust mop. Thirdly, the flexible mechanisms are made from steel and after being in use for a while they start to corrode or the spring on the release mechanism wears out.

Prior art has been patented on mechanisms or attachments that allow for a flexible joint between the floor dust mop head and floor dust mop handle. However, to date all prior arts are quite costly to manufacture due to the expense of springs and their installation into the floor dust mop head, e.g., U.S. Pat. No. 2,286,655 issued Jun. 16, 1942 to Frederick Supnick.

Therefore, a significant need exists to improve upon the previous patents that allows for a more cost effective flexible attachment to be made out of a single piece of elastomeric material, thereby eliminating costly mechanisms that require assembly and could corrode. It is also desirable to provide a flexible attachment that is economic to manufacture so that a floor dust mop that can flex back without operator movement when cleaning around comers, doorways and obstacles on the floor in order for it to be easily negotiated when it is necessary to sweep adjacent or around them.

SUMMARY OF THE INVENTION

The present invention is a mechanism that is affixed at a location between a floor dust mop handle and a head of the floor dust mop to provide a flexible member at the junction where the handle is attached to the floor dust mop head. Through use of the flexible elastomeric member, when the floor dust mop head comes in contact with a stationary object, the floor dust mop will flex beyond 90 degrees deflection around the longitudinal axis in relation to the floor dust mop handle.

It is therefore an object of the present invention to provide an apparatus by which a conventional floor dust mop head can efficiently utilize a flexible elastomer floor dust mop handle attachment that can be economically manufactured.

It is a further object of the present invention to provide an insert that can be adapted to existing floor dust mop heads to provide flexibility.

It is an additional object of the present invention to provide an attachment which can be attached to the forward end of the floor dust mop handle to thereby provide the option of selling a handle with insert attached which can be affixed to the top of the head of a floor dust mop head.

Further novel features and other objects of the present invention will become apparent from the following detailed description, discussion and the appended claim, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
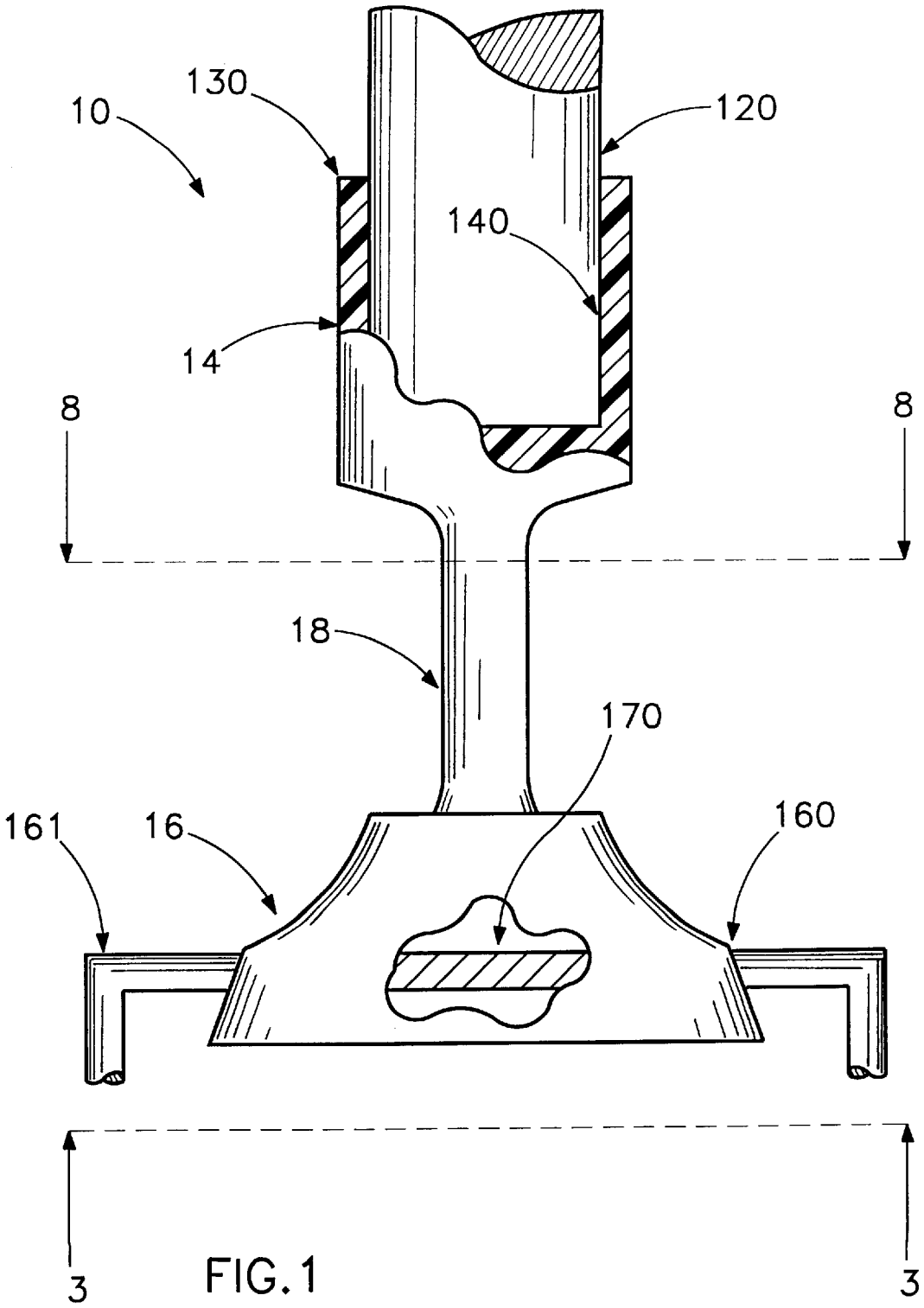
FIG. 1 is a perspective view of the preferred embodiment of the present invention floor dust mop handle apparatus attached to the floor dust mop frame.

In the preferred embodiment, the insert member 10 in FIG. 1 is made of any flexible substance with memory such as rubber, urethane, nylon, plastic, titanium, and polyvinyl. It is also within the spirit and scope of the present invention for the attachment to be made of flexible but strong plastic such as MYLAR®, polypropylene or any other flexible material exhibiting the required characteristics.

Referring to FIG. 1, there is shown at 10 the present invention flexible floor dust mop handle attachment. The apparatus is made from an elastomeric material comprised of a one-piece unitary molded body. In the preferred embodiment, the flexible member 10 comprises a longitudinal section 14 and a lateral section 16 that are interconnected through a flexible connecting section 18 that is not limited to any shape or form, e.g., rectangular, oval, square, etc. when viewed looking down the longitudinal axis as depicted in the cross sectional view of FIG. 8. However, it should be noted that a rectangular shape is more economical due to the optimizing of the expensive elastomer material needed to produce the flexible member 18. A rectangular shape allows for the flexible member to flex around the lateral axis with less material needed to retain rigidity in the forward and aft movement when pushing and pulling the floor dust mop handle. In general appearance, the one piece molded insert looks similar to an extended Roman numeral I (when viewed from a front elevational view, see FIG. 1) with the top portion, item 130 being the receptacle to hold the floor dust mop handle 120. The floor dust mop handle is supported by the attachment body 14 that is a recessed cavity to hold the floor dust mop handle. Accordingly,the upper sleeve portion of the cylindrical sleeve section 130 includes an axial bore 140 having a uniform dimension so as to receive therein the transverse dimension of the handle 120. The thickness of the material encapsulating handle 120 is sufficient to not crack when impact to the head of the floor dust mop occurs. The upper sleeve section 130 has a diameter to tightly receive in a generally slip-fit relationship the transverse dimension of the handle to frictionally retain the handle therein. It will be appreciated that the handle is not limited to the slip-fit engagement. It is emphasized that while the slip-fit engagement is preferred, it is also within the spirit and scope of the present invention to utilize threaded means or attached means such as a bolt or rivet. The overall configuration of the flexible member 18 as it joins to the floor dust mop frame support clamp recess cavity 160 resembles an inverted "T" with the mid portion of the vertical leg being thin in the middle and the lower portion of the leg extending outboard in both the left and right lateral directions to form the clamp mechanism 16 as shown in FIG. 1. The clamp mechanism when attached to the floor dust mop frame 170 retains the floor dust mop head.

Figure 2:
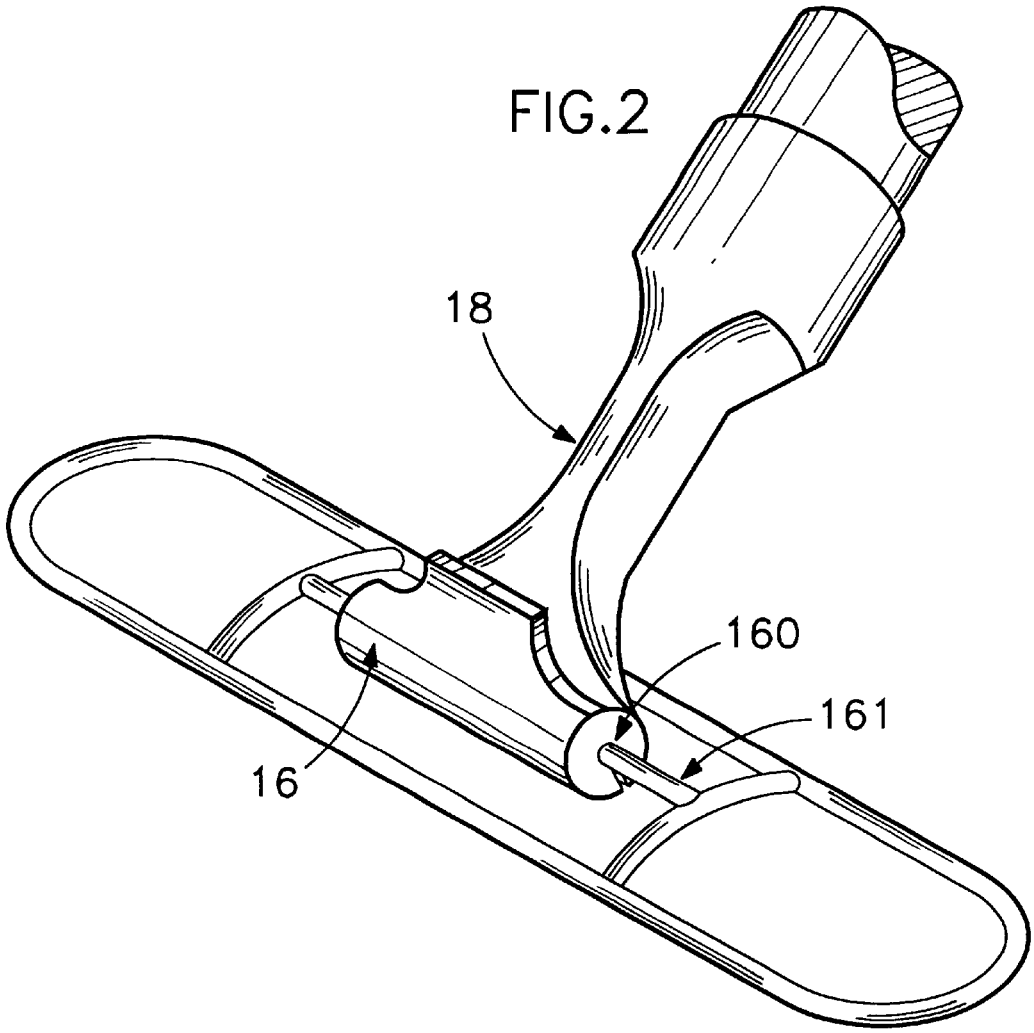
FIG. 2 is a perspective view of the preferred embodiment of the present invention floor dust mop handle apparatus attached to the floor dust mop frame.

Referring to FIG. 2, there is illustrated in a perspective view the relationship between the floor dust mop frame and floor dust mop handle attachment. The floor dust mop support frame 161 is encapsulated by the clamp mechanism 16 and supported by the lateral recess cavity 160. The flexible member 18 adjoins the clamp mechanism 16.

Figure 3:
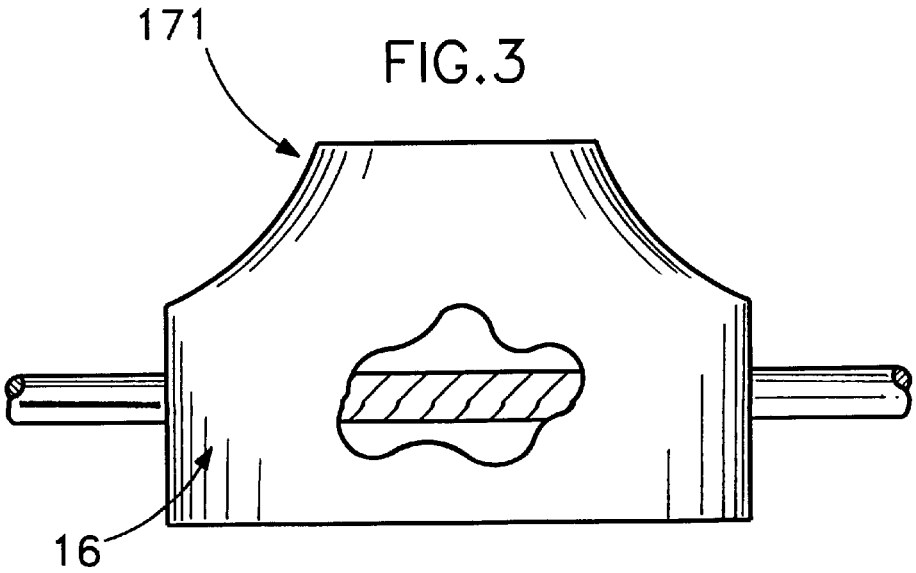
FIG. 3 is a cross-sectional view looking up taken along line 3—3 of FIG. 1.

Referring to FIG. 3, there is illustrated the clamp mechanism 16 and the protruding push lever 171 that allows leverage to open the jaws of the clamp.

Figure 4:
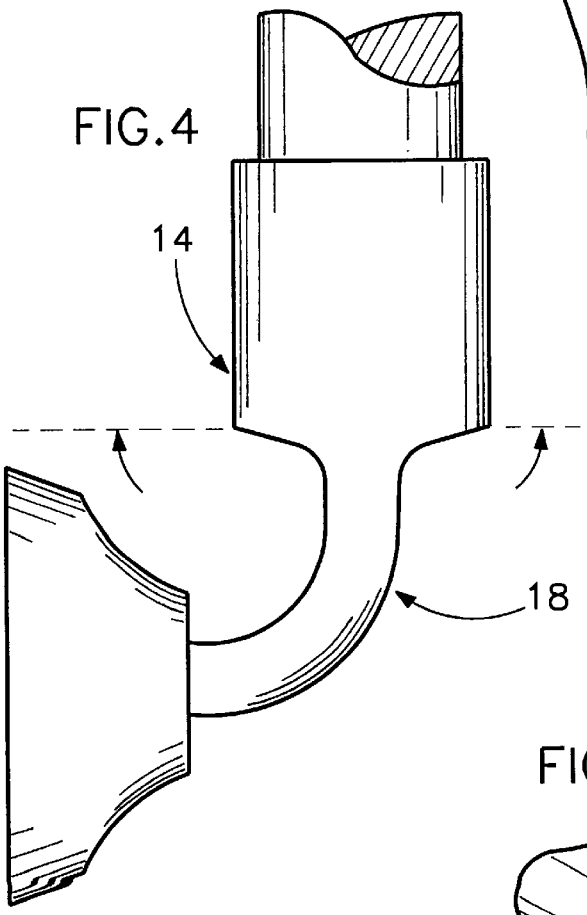
FIG. 4 is a front elevational view of the preferred embodiment of the present invention floor dust mop handle apparatus illustrating the movement of the attachment when in contact with a stationary object.

Referring to FIG. 4, there is illustrated the movement of the flexible connector when in contact with a stationary object. The floor dust mop attachment is made of an elastomeric material member 18 which can flex over 90 degrees in relation to the floor dust mop handle support 14.

Figure 5:
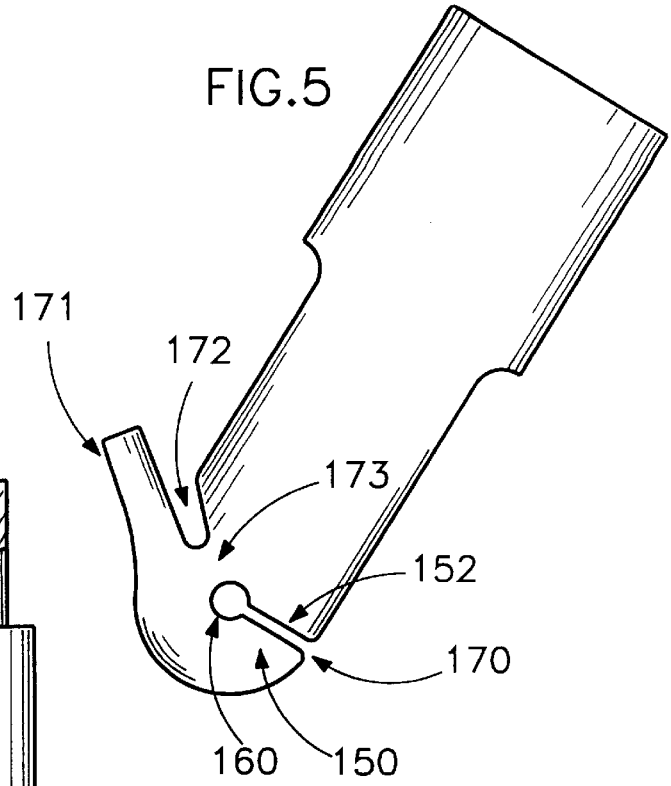
FIG. 5 is a side elevational view of the preferred embodiment of the present invention floor dust mop handle apparatus.

Referring to FIG. 5, there is illustrated the unitary elastomeric clamp mechanism. The clamp mechanism 16 has an upper jaw 152 and lower jaw 150 with an opening 170 that extends laterally. Opening 170 allows for access to cavity 160 that loosely supports the floor dust mop frame in order to pivot along the lateral axis. The upper clamp 152 remains rigid while the lower clamp 150 pivots around the lateral axis at 172. Protruded lever 171 when depressed displaces cavity 172 allowing for lower clamp 150 to move forward in relation to upper clamp 152 allowing for opening 170 to enlarge as shown in FIG. 6.

Figure 6:
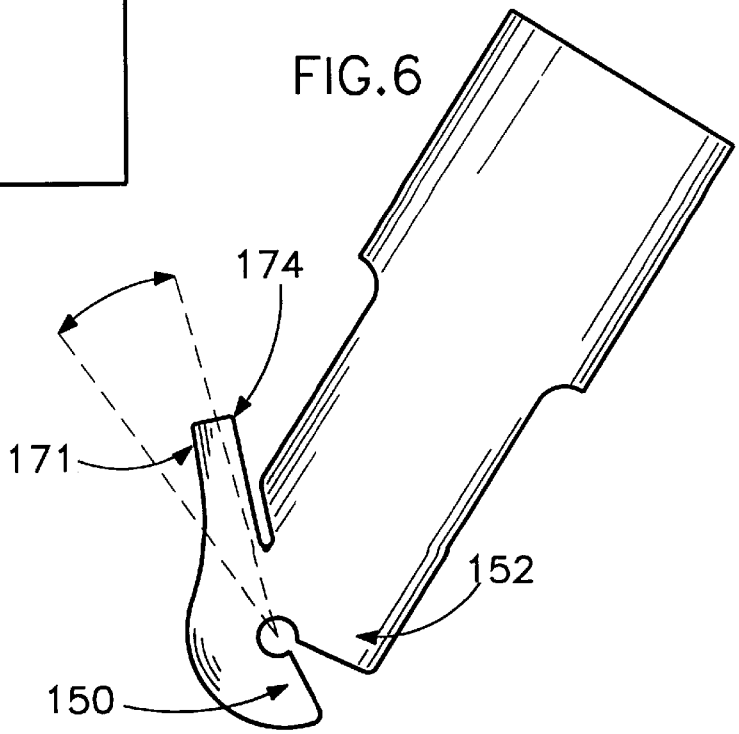
FIG. 6 is a side elevational view of the preferred embodiment of the present invention floor dust mop handle apparatus illustrating the movement of the elastomer hinge allowing an opening for the floor dust mop support frame to be attached.

Referring to FIG. 6, there is illustrated the movement of the clamp mechanism between upper and lower clamps 152 and 150 when force is applied to the protruded lever 171 on side 174.

Figure 7:
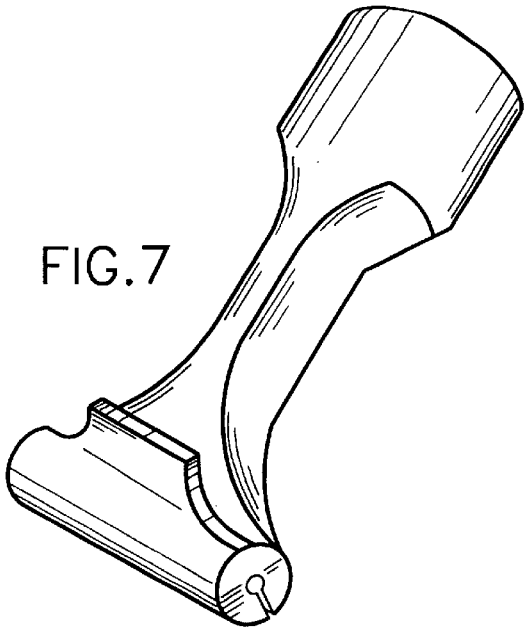
FIG. 7 is an isometric view of the flexible floor dust mop handle attachment in its entirety.

Referring to FIG. 7, there is an isometric illustration of the molded flexible attachment in its entirety.

Figure 8:
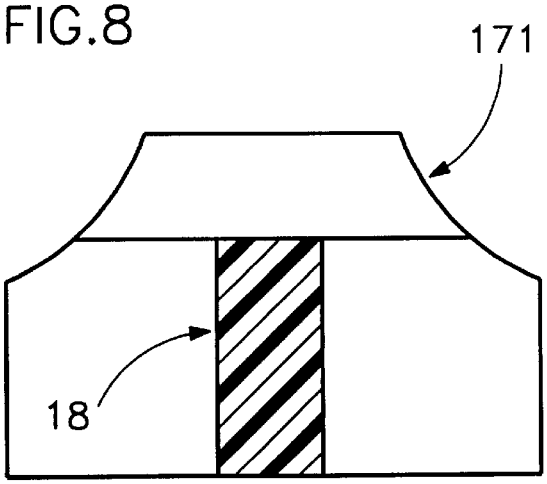
FIG. 8 is a cross-sectional view looking down taken along line 8—8 of FIG. 1.

Referring to FIG. 8, there is illustrated a cross sectional view with the flexible elastomeric material shaped as a rectangle shape. The purpose of a rectangular shape is to allow for maximum flexibility in the lateral movement yet retains rigidity in the forward and aft movement.

Figure 9:
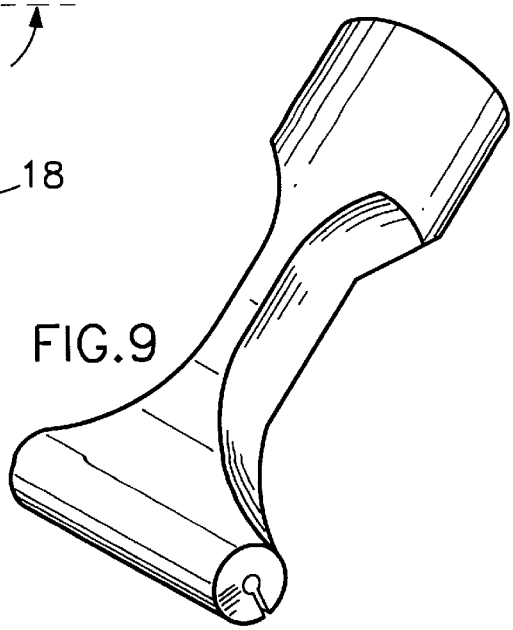
FIG. 9 is an isometric view of the flexible floor dust mop handle alternate attachment in its entirety.

Referring to FIG. 9, there is shown an isometric illustration of an alternative embodiment of present invention molded flexible attachment without the protruding lever to ease in opening the clamp in its entirety.

This alternative embodiment is identical for attaching the base of the apparatus to a floor dust mop frame which is illustrated in FIG. 9. The alternative attachment is identical to the previous attachment described above except that there is no protruding lever 171. However, there is still the open recessed cavity 172 as depicted in FIG. 5 that allows for ease of installing the attachment onto the floor dust mop frame. To install the alternative embodiment, the operator must apply force to press on the attachment onto the floor dust mop frame.

Defined broadly, the present invention is a flexible unitary one piece molded floor dust mop to handle attachment to thereby provide a controlled flexible connection between the handle and head of the floor dust mop head to cause the floor dust mop head to move back and forth and the flexible insert being flexible.

Therefore, through use of the present invention, a flexible floor dust mop attachment can be manufactured that is economical, won't corrode and automatically rebound back when striking a stationary obstacle.

Of course the present invention is not intended to be restricted to any particular form or arrangement, or any specific embodiment disclosed herein, or any specific use, since the same may be modified in various particulars or relations without departing from the spirit or scope of the claimed invention herein above shown and described of which the apparatus shown is intended only or illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A dust mop, comprising:

a. an elongated transverse dust mop head member having a top mounting surface and a bottom cleaning surface, the top mounting surface having a support frame thereto;

b. a unitary flexible attachment member having a transverse clamping section, a longitudinal attachment section and a flexible connecting section integrally connecting the clamping section and the attachment section;

c. said clamping section having an upper jaw and a lower jaw, where the upper and lower jaws form a slotted opening which interconnects with a retaining cavity for receiving said support frame;

d. a push lever integrally formed with said lower jaw such that when the push lever is forced inwardly, said lower jaw moves away from said upper jaw for allowing said support frame of said dust mop head member to be inserted through said slotted opening and secured within said retaining cavity when the push lever is released;

e. said longitudinal attachment section having an axial bore with an open end;

f. an elongated handle member having one end press-fitted from said open end and secured within said axial bore of said attachment section of said flexible attachment member; and g. said flexible connecting section having a generally rectangular shaped cross section which is thinner than said clamping section and said attachment section for allowing lateral flexing of said clamping section;

h. whereby said flexible attachment member allows said handle member to maneuver said dust mop head member to be pushed back and forth while at the same time allows said handle member to move laterally relative to said dust mop head member and when said dust mop head member comes in contact with an object, said flexible connecting section allows lateral flexing of said dust mop head member.

2. The dust mop in accordance with claim 1 wherein said flexible attachment member is made out of elastomer material.

3. The dust mop in accordance with claim 1, wherein said flexible attachment member is made out of plastic material.

4. An attachment member to be used in conjunction with a dust mop having a handle and a laterally disposed cleaning head with a bottom cleaning surface and a top mounting surface having a support frame, the attachment member comprising:

a. a unitary flexible body having a transverse clamping section, a longitudinal attachment section and a flexible connecting section integrally connecting the clamping section and the attachment section;

b. said clamping section having an upper jaw and a lower jaw, where the upper and lower jaws form an opening which interconnects with a retaining means for receiving said support frame;

c. means for forcing either one of said upper and lower jaws away from the other one of said upper and lower jaws for allowing said support frame of said cleaning head to be inserted through said opening and secured within said retaining means;

d. said longitudinal attachment section having an axial bore for receiving and press-fitting one end of said handle member thereto; and e. said flexible connecting section having a thickness which is thinner than said clamping section and said attachment section for allowing lateral flexing of said clamping section;

f. whereby said attachment member allows said handle to maneuver said cleaning head to be pushed back and forth while at the same time allows said handle to move laterally relative to said cleaning head and when said cleaning head comes in contact with an object, said flexible connecting section allows lateral flexing of said cleaning head.

5. The attachment member in accordance with claim 4, wherein said flexible body is made out of elastomer material.

6. The attachment member in accordance with claim 4, wherein said flexible body is made out of plastic material.

7. The attachment member in accordance with claim 4, wherein said flexible connecting section is generally a rectangular shaped cross section.

8. The attachment member in accordance with claim 4, wherein said means for forcing either one of said upper and lower jaws away from the other one of said upper and lower jaws includes a push lever integrally formed with said lower jaw such that when the push lever is forced inwardly, said lower jaw moves away from said upper jaw for allowing said support frame of said dust mop head member to be inserted through said opening and secured within said retaining means when the push lever is released.

9. The attachment member in accordance with claim 4, wherein said retaining means includes a cavity.

10. An attachment member to be used in conjunction with a cleaning apparatus having a handle and a laterally disposed cleaning head with a frame, the attachment member comprising:

a. a body having a clamping section, an attachment section and a flexible connecting section connecting the clamping section and the attachment section, the attachment section having means for receiving and securing one end of said handle thereto;

b. said clamping section having an upper jaw and a lower jaw, where the upper and lower jaws form an opening which interconnects with a retaining means for receiving said frame of said cleaning head;

c. means for forcing either one of said upper and lower jaws away from the other one of said upper and lower jaws for allowing said frame of said cleaning head to be inserted through said opening and secured within said retaining means; and d. said flexible connecting section having a thickness which is thinner than the thickness of said clamping section and said attachment section for allowing lateral flexing of said clamping section;

e. whereby said attachment member allows said handle to maneuver said cleaning head of said cleaning apparatus to be pushed back and forth while at the same time allows said handle to move laterally relative to said cleaning head and when said cleaning head comes in contact with an object, said flexible connecting section allows lateral flexing of said cleaning head.

11. The attachment member in accordance with claim 10, wherein said body is made out of elastomer material.

12. The attachment member in accordance with claim 10, wherein said body is made out of plastic material.

13. The attachment member in accordance with claim 10, wherein said means for forcing either one of said upper and lower jaws away from the other one of said upper and lower jaws includes a push lever integrally formed with said lower jaw such that when the push lever is forced inwardly, said lower jaw moves away from said upper jaw for allowing said frame of said cleaning head to be inserted through said opening and secured within said retaining means when the push lever is released.

14. The attachment member in accordance with claim 10, wherein said flexible connecting section is a generally rectangular shaped cross section.

15. The attachment member in accordance with claim 10, wherein said retaining means includes a cavity.

16. The attachment member in accordance with claim 10, wherein said means for receiving and securing one end of said handle thereto includes an axial bore.

* * * * *